US005898377A

United States Patent [19]

Adachi

[11] Patent Number: 5,898,377

[45] Date of Patent: Apr. 27, 1999

[54] SMOKE DETECTING APPARATUS AND METHOD

[75] Inventor: Izumi Adachi, Hamamatsu, Japan

[73] Assignee: Hamamatsu Photonics K.K., Hamamatsu, Japan

[21] Appl. No.: 08/831,715

[22] Filed: Apr. 1, 1997

[30] Foreign Application Priority Data

Apr. 1, 1996 [JP] Japan ..... 96-079086

[51] Int. Cl.[6] ..... G08B 17/10

[52] U.S. Cl. ..... 340/630; 340/628; 250/573; 250/574

[58] Field of Search ..... 340/628, 630; 250/573, 574

[56] References Cited

U.S. PATENT DOCUMENTS

| | | | |
|---|---|---|---|
| 3,316,410 | 4/1967 | Meili | 250/218 |
| 3,889,755 | 6/1975 | Dunn | 169/59 |
| 3,915,236 | 10/1975 | Stichling | 169/61 |
| 4,163,969 | 8/1979 | Enemark | 340/630 |
| 4,300,133 | 11/1981 | Solomon | 340/632 |
| 4,420,746 | 12/1983 | Malinowski | 340/630 |
| 4,559,453 | 12/1985 | Muggli et al. | 340/630 |
| 4,649,282 | 3/1987 | Ota et al. | 340/630 |
| 4,695,734 | 9/1987 | Honma et al. | 250/573 |
| 4,851,819 | 7/1989 | Kawai et al. | 340/630 |
| 4,897,634 | 1/1990 | Sawa et al. | 340/630 |
| 5,008,559 | 4/1991 | Beyersdorf | 340/630 |
| 5,023,601 | 6/1991 | McGannon | 340/628 |
| 5,280,272 | 1/1994 | Nagashima et al. | 340/628 |
| 5,530,433 | 6/1996 | Morita | 340/630 |
| 5,576,697 | 11/1996 | Nagashima et al. | 340/630 |
| 5,623,253 | 4/1997 | Narumiya et al. | 340/630 |
| 5,670,948 | 9/1997 | Mochizuki et al. | 340/630 |

FOREIGN PATENT DOCUMENTS

| | | |
|---|---|---|
| 0 227 320 | 7/1987 | European Pat. Off. . |
| 0 463 795 A1 | 1/1992 | European Pat. Off. . |
| 2 480 499 | 10/1981 | France . |
| 2-90085 | 3/1990 | Japan . |
| 3-120640 | 12/1991 | Japan . |
| 2 172701 A | 9/1986 | United Kingdom . |

*Primary Examiner*—Edward Lefkowitz
*Attorney, Agent, or Firm*—Pillsbury Madison & Sutro LLP

[57] ABSTRACT

The smoke detecting apparatus of the present invention comprises a detection space (52) into which generated smoke is to be introduced; light-emitting means (2) for emitting a predetermined coded light pulse train into the detection space (52); light-detecting means (3) for detecting scattered light which is generated when the light emitted from the light-emitting means (2) is scattered by the smoke and generating an electric signal corresponding to the detected light; and control means (4) for generating a burst code signal composed of a pulse train coded with a reference pulse to the light-emitting means (2) and judging that the smoke exists in the detection space (52) when the pulse patterns of thus compared signals coincide with each other. According to this configuration, the apparatus can securely operate at the time of smoking and cannot detect when there is no smoke.

6 Claims, 3 Drawing Sheets

SMOKE DETECTING APPARATUS AND METHOD

BACKGROUND OF THE INVENTION

1. Field of the Invention

The present invention relates to a smoke detecting apparatus and method for detecting smoke within an electrical equipment such as television.

2. Related Background Art

When smoke or fire is generated within an electrical equipment such as television, most of the inside of the electrical equipment may be burned before the smoke or flame comes out therefrom. In this case, not only the electrical equipment itself is burned down but also its vicinity is likely to catch fire. Known as a fire alarm system for detecting such smoke within an electrical equipment or the like in its early stage is a safety device for electrical equipment disclosed in Japanese Utility Model Application Laid-Open No. 3-120640. This safety device comprises a smoke sensor for detecting smoke generated within an electrical equipment. When the smoke generated within the electrical equipment is detected by the smoke sensor, the electric power supplied to the electrical equipment is stopped in order to prevent a fire accident after the smoking.

In this safety device, however, there is a possibility that the smoke sensor may malfunction under the influence of electromagnetic noises from a number of parts such as electric circuits disposed within the electrical equipment. Also, there is a possibility that the smoke sensor may malfunction due to dust or the like which is floating by an air convection in the inner space of the electrical equipment causing by changes in temperature and the like therein.

SUMMARY OF THE INVENTION

In order to eliminate the foregoing possibilities of malfunctions, it is an object of the present invention to provide a smoke detecting apparatus and method which securely detects at the time of smoking and does not detect when there is no smoke.

Thus, the smoke detecting apparatus of the present invention comprises a detection space into which generated smoke is to be introduced; light-emitting means for emitting a predetermined coded light pulse train into the detection space; light-detecting means for detecting scattered light which is generated when the light emitted from the light-emitting means is scattered by the smoke and generating an electric signal corresponding to the detected light; and control means for transmitting a predetermined code signal to the light-emitting means so as to control the emission of the light pulse train and judging, based on the code signal and the output electric signal of the light-detecting means, whether there exists the smoke in the detection space or not.

In accordance with the present invention, the light pulse train is emitted into the detection space according to a code signal, and the scattered light reflected by smoke within the detection space is detected. Since thus detected light signal is based on the code signal, it can easily be separated from the noise component. Accordingly, sensors are securely prevented from occurring malfunctions in the smoke detection.

Here, the present invention may be configured such that the code signal is a burst code signal composed of a pulse train which is coded with a reference pulse; the light-emitting means emits a light pulse train which is in synchronization with a pulse of the burst code signal; and the control means compares the burst code signal and the output electric signal of the light-detecting means with each other and, respectively when their pulse patterns substantially coincide with each other and not, judges that the smoke exists in the detection space and not.

In this case, the light emitted into the detection space has the same pulse pattern as the burst code signal. Accordingly, the scattered light has the same pulse pattern as the burst code signal, whereby it can securely be judged whether the output electric signal of the light-detecting means is caused by the scattered light or not.

Also, the present invention may be configured such that the detection space is disposed at a portion within an electrical equipment which is prone to generate the smoke, and the control means shuts off the power supply to the electrical equipment when it judges that the smoke exists. According to this, when smoke is generated within the electrical equipment, the power supply is automatically stopped, whereby an electrical equipment is prevented from occurring ignition.

In a configuration of the present invention, the above-mentioned light-emitting means and light-detecting means are disposed within a shielding case which is shielded from electromagnetic noises, and the detection space is formed within the shielding case, while an inlet for introducing the smoke into the detection space is formed in a side wall of the shielding case.

According to this, the influence of the electromagnetic noises within the electrical equipment upon the light-emitting means and light-detecting means is alleviated, whereby the apparatus is prevented from malfunctions due to such electromagnetic noises.

In the present invention, further may comprise a net attached over the inlet for preventing unnecessary substances from proceeding into the detection space.

According to this, the net securely prevents from malfunctions caused by unnecessary substances proceeding into the detection space.

In another aspect, the smoke detecting apparatus of the present invention comprises a detection space which is disposed within an electrical equipment and into which generated smoke is to be introduced; light-emitting means for emitting into the detection space a predetermined light pulse train corresponding to a code signal transmitted from a control section of the electrical equipment; and light-detecting means for detecting scattered light which is generated when the light emitted from the light-emitting means is scattered by the smoke and generating an electric signal corresponding to the detected light to the control section of the electrical equipment.

According to this, the scattered light at the time of smoking corresponds to the code signal transmitted from the control section of the electrical equipment, whereby the smoke detecting apparatus outputs, at the time of smoking, the electric signal corresponding to the code signal. Accordingly, noises in the output signal can easily be separated therefrom.

On the other hand, the smoke detecting method of the present invention comprises the steps of placing within an electrical equipment a detection space for introducing generated smoke; emitting into the detection space a predetermined light pulse train corresponding to a code signal transmitted from a control section of the electrical equipment; detecting scattered light generated when the light pulse train is scattered by smoke and generating an electric signal corresponding thereto to the control section of the electrical equipment; and, in the control section of the electrical equipment, comparing the output electric signal with the code signal and judging that the smoke exists within the detection space and not respectively when the pulse patterns of thus compared signals coincide with each other and not.

In accordance with this method, it can securely be judged whether smoke exists within the detection space or not, without being affected by the noise component within the electrical equipment.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, an embodiment of the smoke detecting apparatus in accordance with the present invention will be explained with reference to attached drawings. Here, among the drawings, constituents identical to each other will be referred to with marks identical to each other without their overlapping descriptions repeated.

Figure 1:
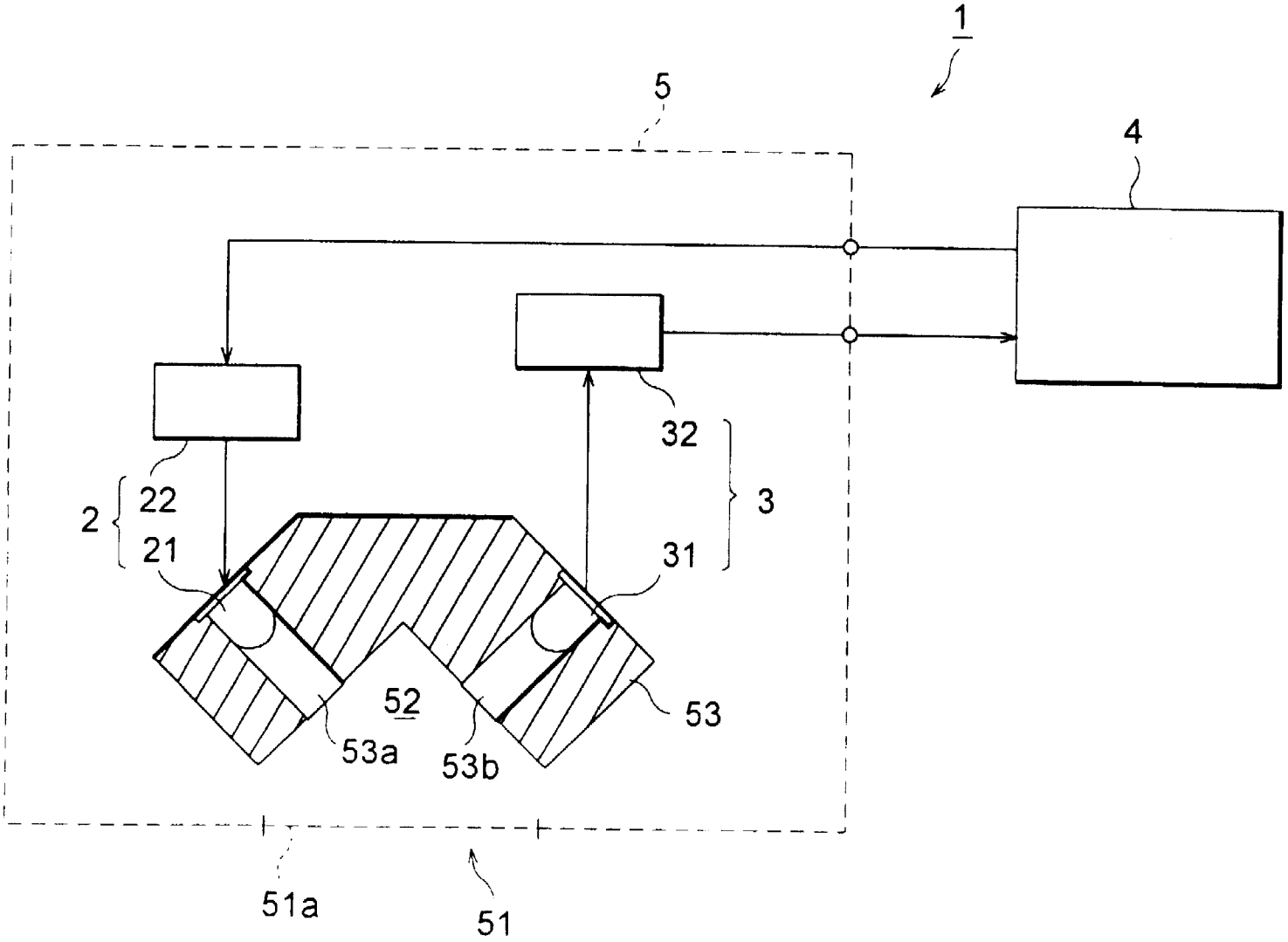
FIG. 1 is a schematic overall view of a smoke detecting apparatus in accordance with the present invention.

FIG. 1 is a schematic overall view showing a smoke detecting apparatus 1. As shown in FIG. 1, the smoke detecting apparatus 1, which is an apparatus for detecting smoke generated within an electrical equipment, comprises a light-emitting section 2, a light-detecting section 3, and a control section 4. The light-emitting section 2 and the light-detecting section 3 are disposed within a shielding case 5, whereas the control section 4 is disposed outside of the shielding case 5. The light-emitting section 2 and the light-detecting section 3 are electrically connected to the control section 4 by leads each which pierce a wall of the shielding case 5. The shielding case 5 is a box having an electromagnetic shielding function. For example, a box made of a metal is used therefor. Also, a side wall of the shielding case 5 is provided with an inlet 51 penetrating therethrough, such that smoke in the outside is introduced into the inside through the inlet 51. The inlet 51 is configured such that a net 51*a* is attached over an opening portion of the side wall of the shielding case 5, so as to prevent unnecessary substances other than the smoke, such as dust, from proceeding into the inlet 51 from the outside. It is preferred that the net 51*a* be made of a material such as a metal which can retain the electromagnetic shielding function of the shielding case 5. Without being restricted to metals, however, any materials can constitute the shielding case 5 as long as they can retain the electromagnetic shielding function of the shielding case 5. Formed on the inside of the inlet 51 in the shielding case 5 is a detection space 52 for detecting whether there is smoke or not.

The light-emitting section 2 is provided so as to emit light toward the detection space 52. The light-emitting section 2, which emits light in order to detect the smoke in the detection space 52, is constituted by a light-emitting diode 21 and a light emission control circuit 22. Used as the light-emitting diode 21, which converts an input electric signal into light and emits thus converted light, is a light-emitting diode which emits light with a single wavelength, for example. The light-emitting diode 21 is attached to an optical table 53. Here, the optical table 53 has two holes 53*a* and 53*b* opening toward the detection space 52, and extensions of their centers substantially cross at right angles in the detection space 52. The light-emitting diode 21 is attached to one of the holes 53*a* so that light can be emitted therefrom toward the detection space 52. On the other hand, as the light emission control circuit 22, which is a circuit for driving the light-emitting diode 21, a switching circuit which can respond to a burst code signal is used, for example.

Also, the light-detecting section 3 is disposed so as to be able to detect the scattered light from the detection space 52. The light-detecting section 3, which detects the scattered light generated by the smoke scattering the light emitted from the light-emitting section 2, is constituted by a photodetector 31 and a preamplifier circuit 32. As the photodetector 31, which converts the light into an electric signal, a photodiode or phototransistor is used, for example. The photodetector 31 is attached to the other hole 53*b* of the above-mentioned optical table 53, for example, so as to be directed toward the detection space 52. In this embodiment, the light emitted from the light-emitting diode 21 attached to the hole 53*a* of the optical table 53 is prevented from being directly incident on the photodetector 31. Namely, since the holes 53*a* and 53*b* of the optical table 53 are made substantially orthogonal to each other, while the light-emitting diode 21 and the photodetector 31 are respectively attached to the inner sides of the holes 53*a* and 53*b*, the light emitted from the light-emitting diode 21 is projected toward the detection space 52 and is prevented from being directly incident on the photodetector 31 when no smoke exists in the detection space 52. When smoke exists in the detection space 52, however, the light emitted from the light-emitting diode 21 is scattered by the smoke, and a part of thus scattered light reaches the photodetector 31. The preamplifier circuit 32, on the other hand, amplifies the output electric signal from the photodetector 31 and eliminates the noise component contained in this electric signal. The preamplifier circuit 32 comprises, at least, an amplifier and a band-pass filter. The band-pass filter has such a frequency characteristic that only the frequency component of the reference pulse in a burst code signal transmitted into the light-emitting diode 21 is passed therethrough. When such a frequency characteristic is established, the unnecessary noise component superposed on the received signal can be eliminated, so that only the desired signal can be detected. Here, the preamplifier circuit 32 may further comprise an integrating circuit and a waveform shaping circuit in addition to the amplifier and the band-pass filter. In this case, the burst code signal is integrated so as to cancel the pulse component for modulation, thereby yielding only a code component. And then, this signal is transmitted as a predetermined code signal after shaping waveform.

Figure 5A:
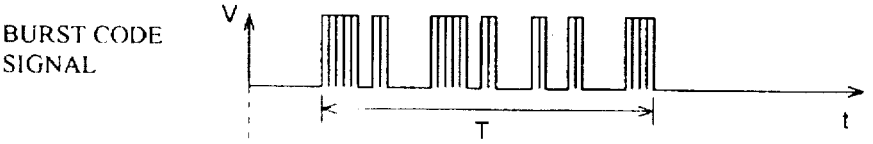
FIGS. 5A and 5B are explanatory views concerning a burst code signal used in the smoke detecting apparatus.
Figure 5B:
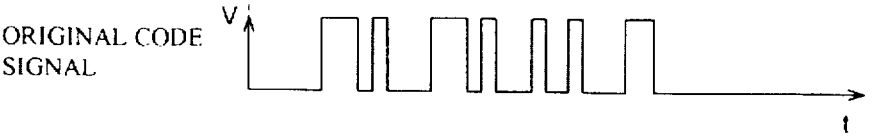

Also, the control section 4 outputs to the light-emitting section 2 the burst code signal which is a control signal for the light-emitting diode 21, detects the light signal detected by the light-detecting section 3, and judges whether the smoke exists in the detection space 52 or not by comparing these signals with each other. Namely, it judges that the smoke exists and not respectively when the burst code signal coincides with the detected light signal and not. As the control section 4, a CPU of a microcomputer having a burst code signal or the like is used. For example, a CPU which is used for other purposes such as remote control of the electrical equipment and is adapted to output a desired burst code signal and compare an input signal with the burst code signal may be used for the control section 4 as well. In this case, when this CPU does not have a comparing function, a comparator circuit may separately be provided in addition to the CPU. Here, "burst code signal" refers to such a signal as that shown in FIG. 5A, which is obtained when a code signal shown in FIG. 5B is modulated with a reference pulse having a higher frequency. For example, the reference pulse is set to about 38 kHz, and a pulse having a frequency lower than the reference pulse is used for coding. In the case where such a burst code signal is used, even when a noise is superposed on this signal, the unnecessary noise can be eliminated alone by a band-pass filter which transmits therethrough only the component near 38 kHz, whereby a desired signal can securely be obtained.

Figure 2:
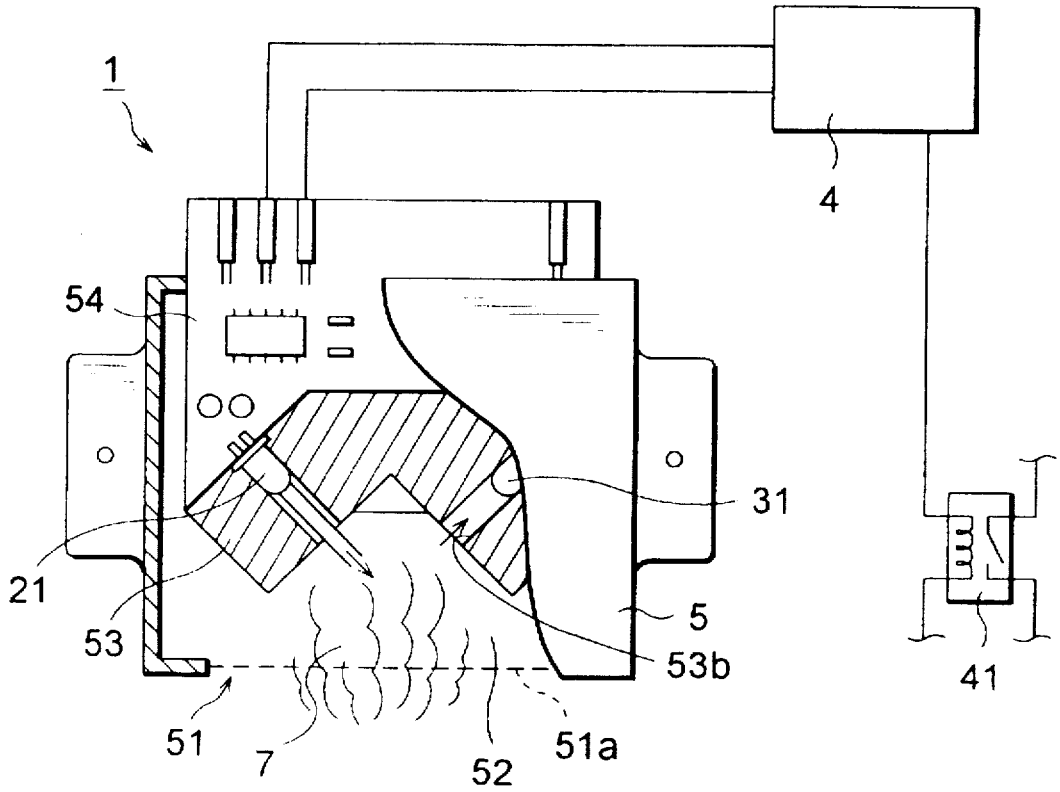
FIG. 2 is an explanatory view concerning smoke detection in the smoke detecting apparatus.
Figure 3:
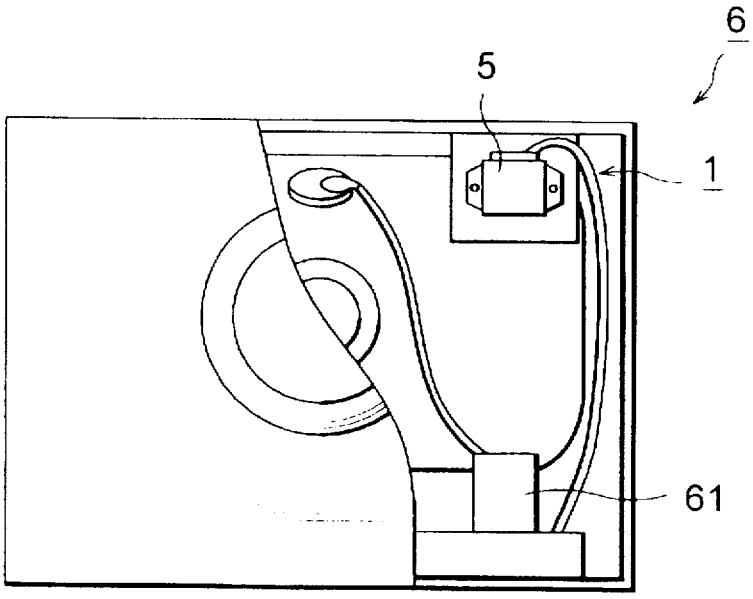
FIG. 3 is an explanatory view concerning the state of installation of the smoke detecting apparatus.

In the following, with reference to FIGS. 2 to 4, the method of using the smoke detecting apparatus 1 will be explained. The following explanation relates to a case where the smoke detecting apparatus 1 is installed within a television 6. FIG. 2 is an explanatory view concerning smoke detection in the smoke detecting apparatus 1 of the present invention, whereas FIG. 3 is a view showing an example of installation of the smoke detection apparatus 1 into the television 6. FIGS. 4A to 4E are timing charts of the respective portions in the smoke detecting apparatus 1 in the steps from the time when electric power is supplied thereto till after the smoke is detected. FIGS. 4A to 4E show changes over time of voltage at the power switch of the television 6, output burst code signal from the control section 4, smoke density, preamplifier 32 output signal which is correspond to the detected light signal of the light-detecting section 3, and voltage of the main power supply of the television 6, respectively.

As shown in FIG. 2, the optical table 53 in which the light-emitting diode 21 and the photodetector 31 are installed is fixed on a printed circuit board 54. Disposed on the printed circuit board 54 are the light emission control circuit 22 and preamplifier circuit 32 shown in FIG. 1. Each of these circuits is connected to the control circuit 4. Here, a CPU which controls turning on/off the power supply in the television 6 by remote control signal from outside the television 6 is also used for the control circuit 4. Further connected to the control circuit 4 is a control element 41 such as a relay circuit for turning on/off the main power supply of the television 6.

As shown in FIG. 3, the smoke detecting apparatus 1 is installed within the television 6 which is an electrical equipment in which smoke is to be detected. The shielding case 5 of the smoke detecting apparatus 1 is installed at a position above a part which is prone to generate smoke, e.g., a high-voltage transformer (flyback transformer) 61, such that the inlet 51 is directed downward. In such a configuration, if the high-voltage transformer 61 generates smoke, the smoke is rapidly and securely flowed into the detection space 52 of the smoke detecting apparatus 1, whereby the smoke is easily detected.

Figure 4A:
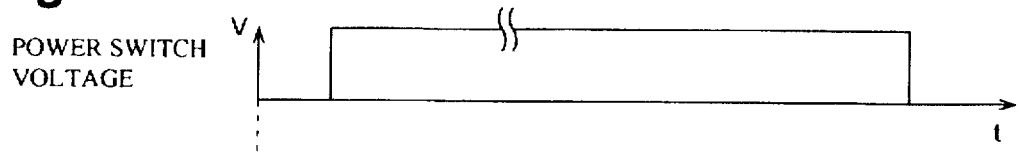
FIGS. 4A to 4E are timing charts for smoke detection in the smoke detecting apparatus.
Figure 4B:
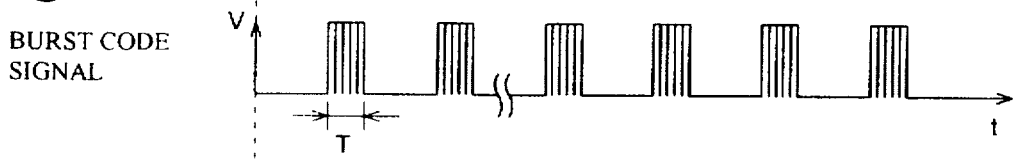

When the power supply of the television 6 is turned on (see FIG. 4A), the control section 4 which is CPU of the television 6 generate a burst code signal which is intermittently emitted with predetermined intervals of time as shown in FIG. 4B. Then, the burst code signal from the control section 4 is transmitted to the light emission control circuit 22 within the shielding case 5 through the lead. In response to the burst code signal, the light emission control circuit 22 actuates the light-emitting diode 21, whereby light is emitted from the light-emitting diode 21 toward the detection space 52. Here, if smoke 7 does not exist in the detection space 52, the light emitted from the light-emitting diode 21 will not be scattered in the detection space 52 and will not be made incident on the photodetector 31. So no electric signal will be generated by this photodetector 31. Consequently, as indicated on the left side of FIG. 4D, the preamplifier circuit 32 will not transmit any signal.

On the other hand, various electromagnetic waves are emitted from electronic parts and the like within the television 6. If such an electromagnetic wave enters a circuit between the output of the photodetector 31 and the input of the preamplifier circuit 32, it will become a noise in the detected signal and be amplified by the preamplifier circuit 32, and it may cause malfunctions. The light-detecting section 3 in the smoke detecting apparatus 1, however, is hardly affected by such an electromagnetic wave since the light-detecting section 3 is disposed within the shielding case 5 together with the light-emitting section 2 and the detection space 52. Also, even if the noise is amplified in the preamplifier circuit 32 and transmitted to the control section 4 under the influence of the electromagnetic wave, the control section 4 will not judge that the smoke 7 exists in the detection space 52 unless there is a signal having a predetermined code (burst code signal). Accordingly, when the smoke 7 does not exist in the detection space 52, the smoke detection apparatus 1 is prevented from malfunctions due to the noise formed by the electromagnetic waves within the television 6.

Also, within the television 6, dust, dirt, and the like exist and are floating due to the convection therewithin generated upon changes in the temperature therein. Nevertheless, since the net 51*a* is attached over the inlet 51 of the shielding case 5, of the dust, dirt, and the like, those having a large size do not proceed into the shielding case 5. Consequently, the smoke detecting apparatus 1 is prevented from malfunctions due to the dust, dirt, and the like within the television 6.

Figure 4C:
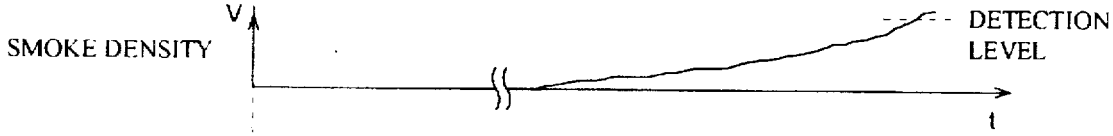
Figure 4D:
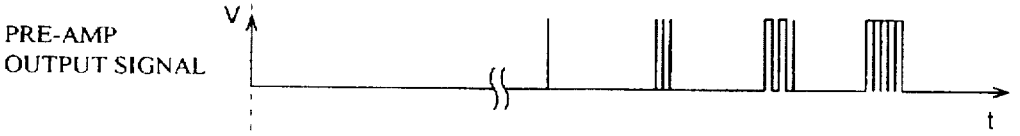
Figure 4E:
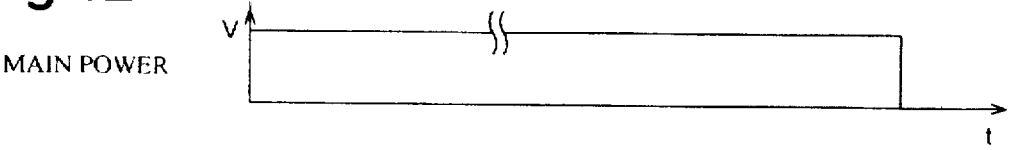

By contrast, when smoke is generated due to a trouble with any electronic parts or the like within the television 6, the smoke 7 proceeds into the detection space 52 of the shielding case 5 as shown in FIG. 2. Then, the light emitted from the light-emitting diode 21 is scattered by the smoke 7, and a part of thus scattered light reaches the photodetector 31 so as to be detected thereby. The relationship between the density of the smoke 7 and the output signal from the preamplifier circuit 32 is represented by FIGS. 4C and 4D. Namely, as the density of the smoke 7 in the detection space 52 increases, the scattered light detected by the photodetector 31 increases, whereby the output signal of the preamplifier circuit 32 gradually approximates the burst code signal.

Then, when the density of the smoke 7 reaches a predetermined level, the output signal of the preamplifier circuit 32 substantially coincides with the burst code signal, whereby the control section 4 judges that the smoke 7 exists in the detection space 52. Here, even if a noise caused by an electromagnetic wave enters the input portion of the preamplifier circuit 32 as mentioned above, the component other than a predetermined frequency component will be eliminated by the band-pass filter of the preamplifier circuit 32. Accordingly, only the signal based on the scattered light component will be modulated to a predetermined frequency (about 38 kHz) in the preamplifier circuit 32. Thus, without being influenced by the electromagnetic noise, the existence of the smoke 7 within the detection space 52 is securely detected. Then, a predetermined signal is transmitted from the control section 4 to the control element 41 for the main power supply of the television 6 so as to turn off the main power supply of the television 6, thereby preventing the television 6 from catching fire.

Here, in order to appropriately set the density level at which the existence of the smoke 7 is judged, the quantity of light emitted from the light-emitting diode 21 of the light-emitting section 2 or the amplification factor in the preamplifier circuit 32 in the light-detecting section 3 may be adjusted, or a lens type element may be used as the light-emitting diode 21 or photodetector 31 (in which an optical lens is formed on the light-emitting or photosensitive surface).

Thus, the smoke detecting apparatus 1 is not affected by the electromagnetic noises or floating substances within the electrical equipment, whereby they do not cause the apparatus 1 to detect nonexistent smoke. On the other hand, when smoke is generated within the electrical equipment, it can securely be detected.

As explained in the foregoing, the present invention can yield the following effects.

Namely, since a coded signal such as a burst code signal is used for emitting and detecting light, smoke can securely be detected without malfunctions, for example, within an electrical equipment which generates a large amount of noises. Accordingly, the trouble with the electrical equipment causing fire accident can be seen before ignition, whereby the present invention can prevent the situation from growing worse.

When the power supply is automatically shut off upon detection of smoke, the electrical equipment can securely be prevented from fire accident.

Also, since smoke is detected within a shielding case, it is hard to be affected by electromagnetic noises, whereby these electromagnetic noises are prevented from generating the error signal.

Further, as the inlet of the shielding case is provided with a net, unnecessary substances are prevented from proceeding into the detection space, whereby the scattered light by the such unnecessary substances does not occur.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 8-079086 (079086/1996) filed on Apr. 1, 1996 is hereby incorporated by reference.

What is claimed is:

1. A smoke detecting apparatus comprising:

structures forming a detection space into which generated smoke is to be introduced;

light-emitting means for emitting a light pulse train which is in synchronization with a pulse of a predetermined burst code signal into the detection space;

a light-detecting means for detecting light from the light-emitting means that is scattered by smoke to be detected and generating an electric signal corresponding to the detected light; and control means for transmitting said burst code signal composed of a pulse train which is coded with a reference pulse to said light-emitting means so as to control the emission of the light pulse train and comparing the burst code signal and the output electric signal of said light-detecting means with each other and, determining, based on the coincidence of these signals with each other or not, judging that the whether or not smoke exists in the detection space.

2. A smoke detecting apparatus according to claim 1, wherein said detection space is disposed at a portion within an electrical equipment which is prone to generate the smoke, and said control means shuts off a power supply to the electrical equipment when it judges that the smoke exists.

3. A smoke detecting apparatus according to claim 1, wherein said light-emitting means and light-detecting means are disposed within a shielding case which is shielded from electromagnetic noises, and the detection space is formed within the shielding case, while an inlet for introducing the smoke into the detection space is formed in a side wall of the shielding case.

4. A smoke detecting apparatus according to claim 3, further, comprising:

a net attached over said inlet for preventing unnecessary substances from proceeding into said detection space.

5. A smoke detecting apparatus comprising:

a detection space which is disposed within an electrical equipment and into which generated smoke is to be introduced;

a light-emitting means for emitting into said detection space a predetermined light pulse train corresponding to a burst code signal transmitted from a control section of the electrical equipment; and a light-detecting means for detecting scattered light which is generated when the light emitted from said light-emitting means is scattered by the smoke and transmitting an electric signal corresponding to the detected light to the control section of the electrical equipment.

6. A smoke detecting method comprising the steps of:

placing within an electrical equipment structures forming a detection space for introducing generated smoke;

emitting into the detection space a predetermined light pulse train corresponding to a burst code signal transmitted from a control section of the electrical equipment;

detecting scattered light generated when the light pulse train is scattered by smoke and generating an electric signal corresponding thereto to the control section of the electrical equipment;

comparing pulse patterns of the output electric signal and the code signal; and, judging that the smoke exists within the detection space and not, respectively when the pulse patterns of thus compared signals coincide with each other and not.

* * * * *